US010080388B2

(12) United States Patent
Sebastian et al.

(10) Patent No.: US 10,080,388 B2
(45) Date of Patent: Sep. 25, 2018

(54) AEROSOL DELIVERY DEVICE INCLUDING A SHAPE-MEMORY ALLOY AND A RELATED METHOD

(71) Applicant: RAI Strategic Holdings, Inc., Winston-Salem, NC (US)

(72) Inventors: Andries Don Sebastian, Clemmons, NC (US); Michael F. Davis, Clemmons, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 0 days.

(21) Appl. No.: 15/415,267

(22) Filed: Jan. 25, 2017

(65) Prior Publication Data

US 2018/0206552 A1 Jul. 26, 2018

(51) Int. Cl.

| | |
|---|---|
| ***A24F 1/10*** | (2006.01) |
| ***A24F 47/00*** | (2006.01) |
| ***H05B 3/00*** | (2006.01) |
| ***H05B 3/06*** | (2006.01) |
| ***H05B 3/03*** | (2006.01) |
| ***H05B 3/12*** | (2006.01) |

(52) U.S. Cl.

CPC ..... *A24F 47/008* (2013.01); *H05B 3/0014* (2013.01); *H05B 3/03* (2013.01); *H05B 3/06* (2013.01); *H05B 3/12* (2013.01); *H05B 2203/021* (2013.01)

(58) Field of Classification Search

CPC ..... A24F 47/008
USPC ..... 131/328, 330
See application file for complete search history.

(56) References Cited

U.S. PATENT DOCUMENTS 4,735,217 A 4/1988 Gerth et al.
4,793,365 A 12/1988 Sensabaugh, Jr. et al.
(Continued)

FOREIGN PATENT DOCUMENTS

WO WO 98/54556 12/1998
WO WO 2010/003480 1/2010
(Continued)

OTHER PUBLICATIONS

Chemical and Biological Studies on New Cigarette Prototypes that Heat Instead of Burn Tobacco, R.J. Reynolds Tobacco Company Monograph, 1988, pp. 43-72.
(Continued)

*Primary Examiner* — Tulsidas C Patel
*Assistant Examiner* — Peter G Leigh
(74) *Attorney, Agent, or Firm* — Womble Bond Dickinson (US) LLP

(57) ABSTRACT

Aerosol delivery devices are provided. The aerosol delivery devices may include a power source configured to output electrical current. The aerosol delivery devices may also include an atomizer in fluid communication with a reservoir containing an aerosol precursor composition, the atomizer being configured to receive electrical current from the power source. The aerosol delivery devices may further include a dispensing mechanism including a shape-memory alloy configured to change shape in response to heat produced from electrical current provided by the power source and to selectively regulate flow of the aerosol precursor composition from the reservoir to the atomizer, the atomizer being configured to produce an aerosol therefrom.

18 Claims, 7 Drawing Sheets

(56) References Cited

U.S. PATENT DOCUMENTS 4,922,901 A 5/1990 Brooks et al.
4,947,874 A 8/1990 Brooks et al.
4,947,875 A 8/1990 Brooks et al.
5,060,671 A 10/1991 Counts et al.
5,093,894 A 3/1992 Deevi et al.
5,101,839 A 4/1992 Jakob et al.
5,154,192 A 10/1992 Sprinkel et al.
5,224,498 A 7/1993 Deevi et al.
5,228,460 A 7/1993 Sprinkel et al.
5,249,586 A 10/1993 Morgan et al.
5,261,424 A 11/1993 Sprinkel, Jr.
5,322,075 A 6/1994 Deevi et al.
5,353,813 A 10/1994 Deevi et al.
5,372,148 A 12/1994 McCafferty et al.
5,468,936 A 11/1995 Deevi et al.
5,498,850 A 3/1996 Das
5,498,855 A 3/1996 Deevi et al.
5,530,225 A 6/1996 Hajaligol
5,573,692 A 11/1996 Das et al.
5,591,368 A 1/1997 Fleischhauer et al.
5,659,656 A 8/1997 Das
5,665,262 A 9/1997 Hajaligol et al.
5,666,977 A 9/1997 Higgins et al.
5,934,289 A 8/1999 Watkins et al.
5,954,979 A 9/1999 Counts et al.
5,967,148 A 10/1999 Harris et al.
6,040,560 A 3/2000 Fleischhauer et al.
6,053,176 A 4/2000 Adams et al.
6,164,287 A 12/2000 White
6,196,218 B1 3/2001 Voges
6,772,756 B2 8/2004 Shayan
6,803,545 B2 10/2004 Blake et al.
6,810,883 B2 11/2004 Felter et al.
6,854,461 B2 2/2005 Nichols et al.
7,040,314 B2 5/2006 Nguyen et al.
7,293,565 B2 11/2007 Griffin et al.
7,513,253 B2 4/2009 Kobayashi et al.
7,726,320 B2 6/2010 Robinson et al.
7,832,410 B2 11/2010 Hon
7,896,006 B2 3/2011 Hamano et al.
8,156,944 B2 4/2012 Han
8,375,957 B2 * 2/2013 Hon ..... A24F 47/008 131/194
8,402,976 B2 3/2013 Fernando et al.
8,511,318 B2 * 8/2013 Hon ..... A24F 47/002 128/202.21
8,689,804 B2 * 4/2014 Fernando ..... A24F 47/008 131/184.1
8,790,590 B1 * 7/2014 Wright, IV ..... A61L 9/14 222/94
8,794,231 B2 8/2014 Thorens et al.
8,851,083 B2 10/2014 Oglesby et al.
8,881,737 B2 * 11/2014 Collett ..... H05B 3/265 128/202.21
8,910,639 B2 12/2014 Chang et al.
8,915,254 B2 12/2014 Monsees et al.
8,925,555 B2 1/2015 Monsees et al.
8,991,402 B2 * 3/2015 Bowen ..... A61M 11/041 131/194
9,010,335 B1 * 4/2015 Scatterday ..... A24F 47/008 128/202.21
9,210,738 B2 12/2015 Ward et al.
9,220,302 B2 12/2015 DePiano et al.
9,277,770 B2 3/2016 DePiano et al.
9,316,212 B2 4/2016 Browne et al.
9,423,152 B2 8/2016 Ampolini et al.
2006/0196518 A1 9/2006 Hon
2009/0151717 A1 * 6/2009 Bowen ..... A61M 11/041 128/200.23
2009/0188490 A1 7/2009 Han
2009/0230117 A1 * 9/2009 Fernando ..... A24F 47/008 219/490
2010/0024834 A1 2/2010 Oglesby et al.
2010/0028766 A1 2/2010 Peckerar et al.
2010/0163063 A1 * 7/2010 Fernando ..... A24F 47/008 131/184.1
2010/0307518 A1 12/2010 Wang
2013/0255702 A1 10/2013 Griffith, Jr. et al.
2014/0000638 A1 1/2014 Sebastian et al.
2014/0096781 A1 4/2014 Sears et al.
2014/0261495 A1 9/2014 Novak, III et al.
2014/0270729 A1 9/2014 DePiano et al.
2015/0027459 A1 * 1/2015 Collett ..... H05B 3/265 131/328
2015/0114409 A1 4/2015 Brammer et al.
2015/0117841 A1 4/2015 Brammer et al.
2015/0117842 A1 4/2015 Brammer et al.
2015/0157056 A1 * 6/2015 Bowen ..... A61M 11/041 131/328
2015/0181935 A1 * 7/2015 Lyubomirskiy ..... A24F 47/008 392/386
2015/0216232 A1 8/2015 Bless et al.
2016/0262453 A1 * 9/2016 Ampolini ..... A24F 47/008
2016/0345631 A1 * 12/2016 Monsees ..... A24F 47/008
2017/0127722 A1 * 5/2017 Davis ..... H05B 6/108

FOREIGN PATENT DOCUMENTS

WO WO 2010/091593 8/2010
WO WO 2013/089551 6/2013
WO WO 2015/097005 7/2015
WO WO 2016/090951 6/2016
WO WO 2016/156213 10/2016
WO WO 2016/156497 10/2016

OTHER PUBLICATIONS

Jani et al., "A Review of Shape Memory Alloy Research, Applications and Opportunities," Materials and Design, 2014, vol. 56, pp. 1078-1113.
Borden, "Shape-Memory Alloys: Forming a Tight Fit," Mechanical Engineering, Oct. 1991, pp. 67-72.

* cited by examiner

AEROSOL DELIVERY DEVICE INCLUDING A SHAPE-MEMORY ALLOY AND A RELATED METHOD

FIELD OF THE DISCLOSURE

The present disclosure relates to aerosol delivery devices, such as smoking articles; and more particularly, to aerosol delivery devices that utilize electrically generated heat for the production of aerosol (e.g., smoking articles commonly referred to as electronic cigarettes). The aerosol delivery devices are configured to heat an aerosol precursor, which incorporates materials made or derived from tobacco or otherwise incorporate tobacco, capable of vaporizing to form an inhalable aerosol for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al. and U.S. Pat. Pub. Nos. 2013/0255702 to Griffith, Jr. et al. and 2014/0096781 to Sears et al., which are incorporated herein by reference. See also, for example, the various types of smoking articles, aerosol delivery devices and electrically powered heat generating sources referenced by brand name and commercial source in U.S. Pat. Pub. No. 2015/0216232 to Bless et al., which is incorporated herein by reference.

However, it is desirable to provide aerosol delivery devices with enhanced functionality. In this regard, it is desirable to improve delivery of an aerosol precursor composition to an atomizer.

BRIEF SUMMARY OF THE DISCLOSURE

The present disclosure relates to an aerosol delivery device including a shape-memory alloy and a related method. In one aspect, an aerosol delivery device is provided. The aerosol delivery device may include a power source configured to output electrical current. The aerosol delivery device may include an atomizer in fluid communication with a reservoir containing an aerosol precursor composition. The atomizer may be configured to receive electrical current from the power source. The aerosol delivery device may include a dispensing mechanism including a shape-memory alloy configured to change shape in response to heat produced from electrical current provided by the power source and to selectively regulate flow of the aerosol precursor composition from the reservoir to the atomizer. The atomizer may be configured to produce an aerosol therefrom.

In some embodiments, the atomizer may include a liquid transport element and a heating element. The heating element may be the dispensing mechanism and may include one or more coils including the shape-memory alloy wrapped about the liquid transport element and configured to change from a first shape, where the one or more coils are at least partially spaced apart from an outer surface of the liquid transport element to allow flow of the aerosol precursor composition into the liquid transport element, to a second shape, wherein the one or more coils are in contact with the outer surface of the liquid transport element to heat the aerosol precursor composition at the liquid transport element and thereby produce the aerosol, in response to heat produced from electrical current from the power source. Upon cessation of receipt of electrical current at the one or more coils, the one or more coils may be configured to return from the second shape to the first shape.

In some embodiments, the dispensing mechanism may include a valve. The valve may be configured to change from a first shape, where the valve is in a closed configuration to prevent the aerosol precursor composition from being dispensed from the reservoir to the atomizer, to a second shape, where the valve is in an open configuration to allow the aerosol precursor composition to be dispensed to the atomizer from the reservoir, relative to a port defined between the reservoir and the atomizer in response to heat produced from electrical current from the power source. Upon cessation of receipt of electrical current at the valve, the valve may be configured to return from the second shape to the first shape.

In some embodiments, the power source, the reservoir, and the atomizer may each be housed in separable housings. In some embodiments, the shape-memory alloy may include a nickel titanium alloy. In some embodiments, the aerosol delivery device may include a flow sensor configured to output a signal corresponding to a draw on the aerosol delivery device and a controller configured to output electrical current to produce heat to change the shape of the dispensing mechanism in response to detection of the draw.

In some embodiments, the dispensing mechanism may include an actuator configured to change from a first shape to a second shape to displace the aerosol precursor composition toward the atomizer. The dispensing mechanism may further include a piston engaged with an interior of the reservoir, the piston being configured to move along a longitudinal axis centrally defined in the reservoir in response to actuation of the actuator.

In an additional aspect, an aerosol delivery device operation method is provided. The method may include providing a power source, an atomizer, a reservoir containing an aerosol precursor composition, and a dispensing mechanism including a shape-memory alloy. The method may also include heating the dispensing mechanism with electrical current output by the power source to change a shape of the dispensing mechanism in order to selectively regulate flow of the aerosol precursor composition from the reservoir to the atomizer. The method may also include directing electrical current from the power source to the atomizer to produce an aerosol from the aerosol precursor composition.

In some embodiments, providing the atomizer may include providing a heating element that is the dispensing mechanism and which includes one or more coils including the shape-memory alloy and a liquid transport element, the one or more coils being wrapped about the liquid transport element. Changing the shape of the dispensing mechanism may include changing, of the one or more coils, from a first shape, where the one or more coils are at least partially spaced apart from an outer surface of the liquid transport element to allow flow of the aerosol precursor composition into the liquid transport element, to a second shape, wherein the one or more coils are in contact with the outer surface of the liquid transport element to heat the aerosol precursor composition at the liquid transport element and thereby produce the aerosol, in response to heat produced from electrical current from the power source. The method may include returning the coils from the second shape to the first shape by ceasing the flow of electrical current thereto.

In some embodiments, changing the shape of the dispensing mechanism, which includes a valve, may include changing from a first shape, where the valve is in a closed configuration to prevent the aerosol precursor composition from being dispensed from the reservoir to the atomizer, to a second shape, where the valve is in an open configuration to allow the aerosol precursor composition to be dispensed to the atomizer from the reservoir, relative to a port defined between the reservoir and the atomizer in response to heat produced from electrical current from the power source. The method may include ceasing receipt of electrical current at the valve. The method may include returning, of the valve, from the second shape to the first shape in response thereto.

In some embodiments, the method may include detecting, by a sensor, a draw. Heating the dispensing mechanism with electrical current provided by the power source may be controlled in response to detection of the draw. In some embodiments, changing the shape of the dispensing mechanism may include changing the shape of an actuator from a first shape to a second shape to displace the aerosol precursor composition toward the atomizer. Changing the shape of the actuator from the first shape to the second shape may include moving a piston engaged with an interior of the reservoir along a longitudinal axis centrally defined in the reservoir in response to actuation of the actuator. These and other features, aspects, and advantages of the disclosure will be apparent from a reading of the following detailed description together with the accompanying drawings, which are briefly described below.

BRIEF DESCRIPTION OF THE FIGURES

Figure 1A:
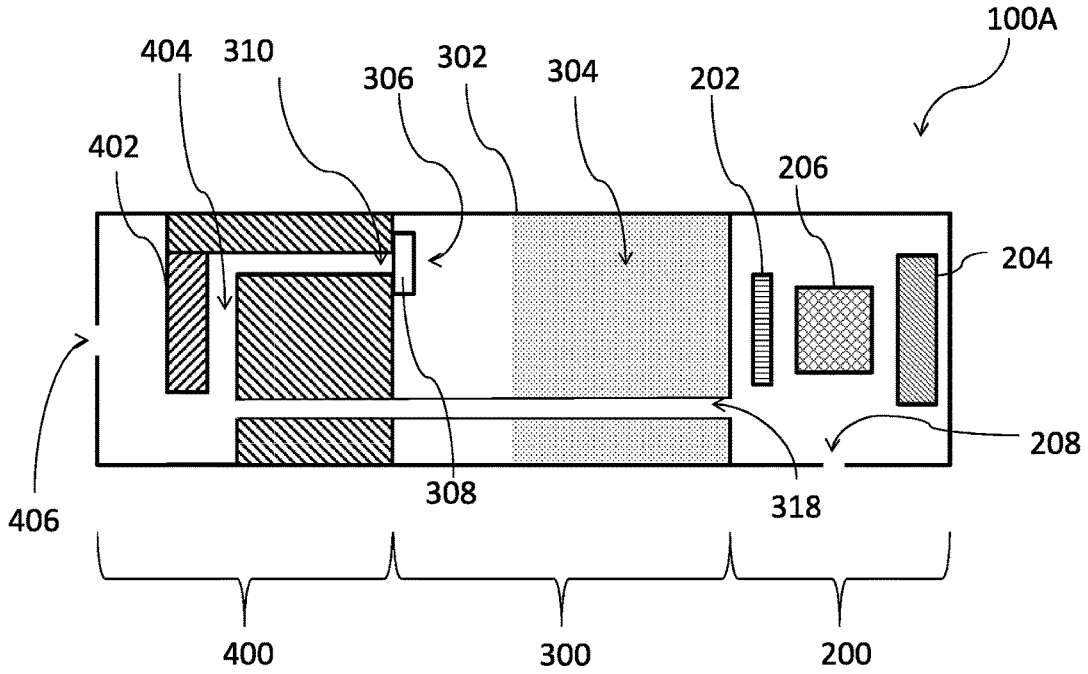
Figure 1B:
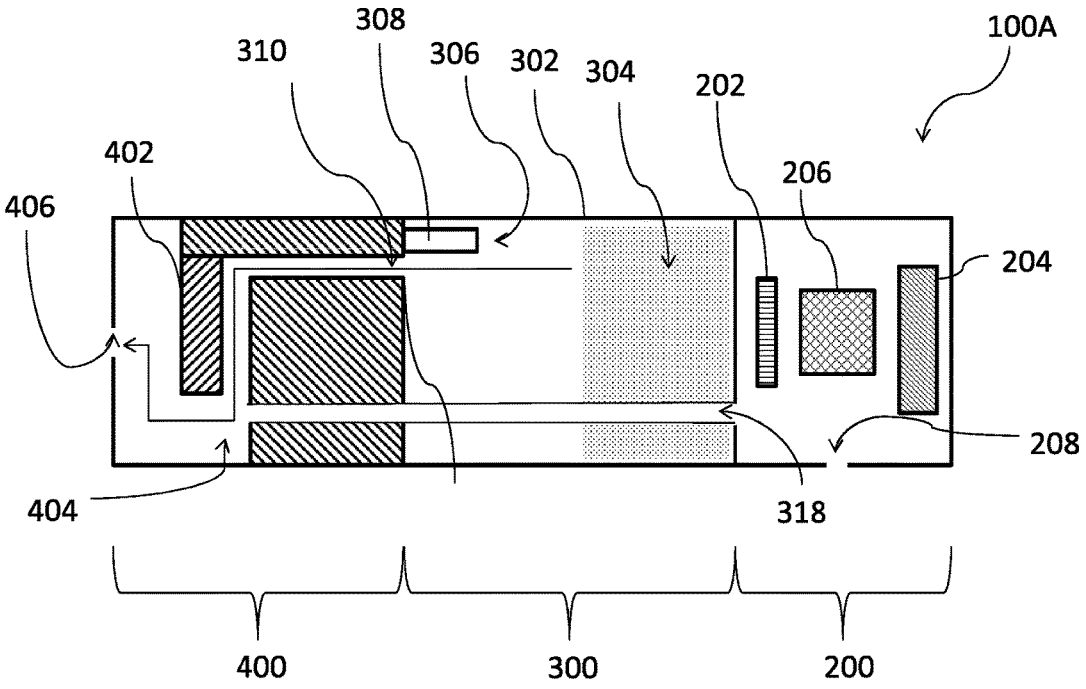
Figure 2A:
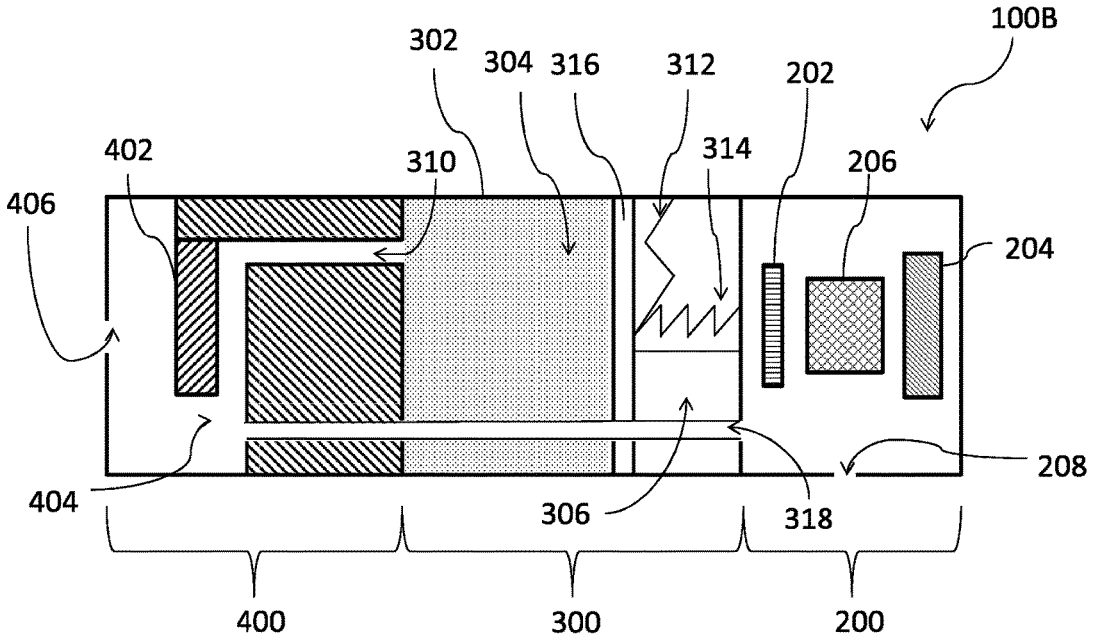
Figure 2B:
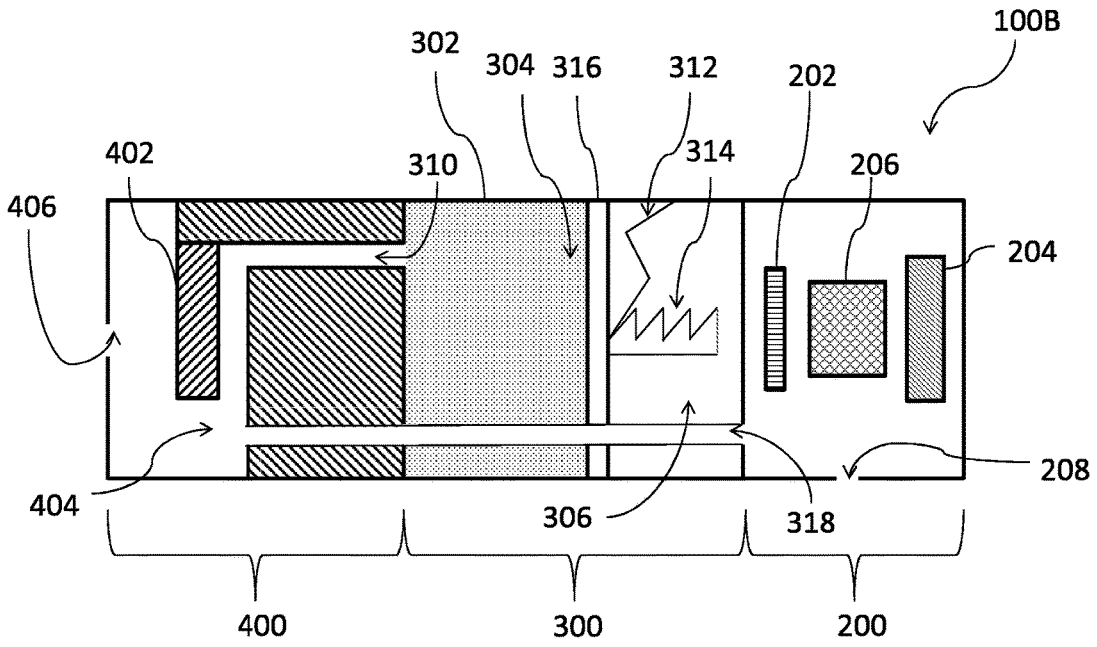
Figure 2C:
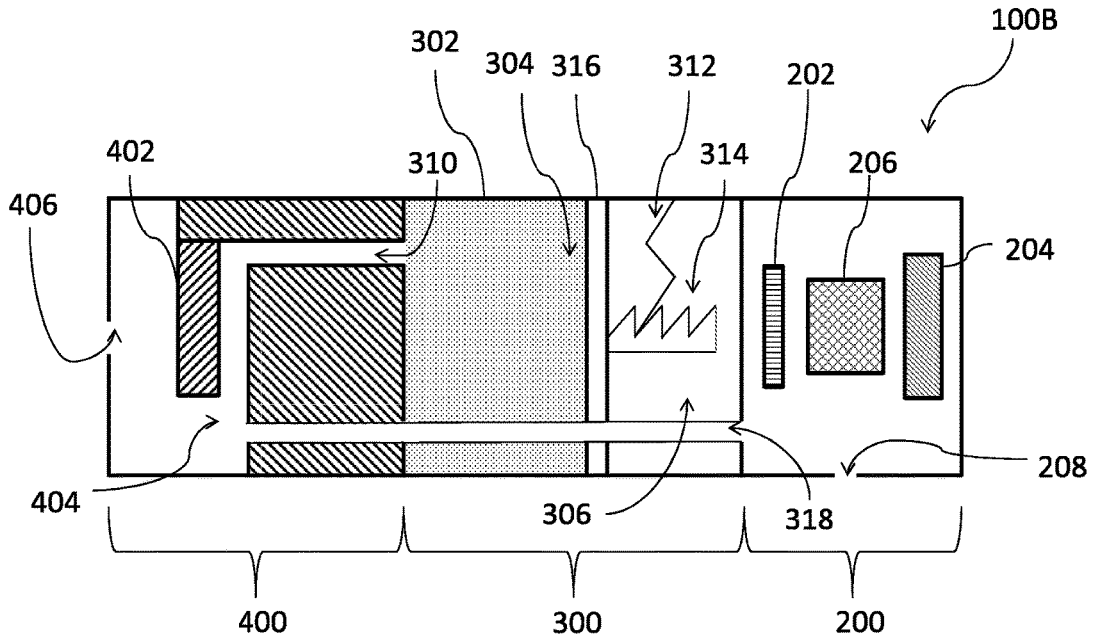
Figure 3A:
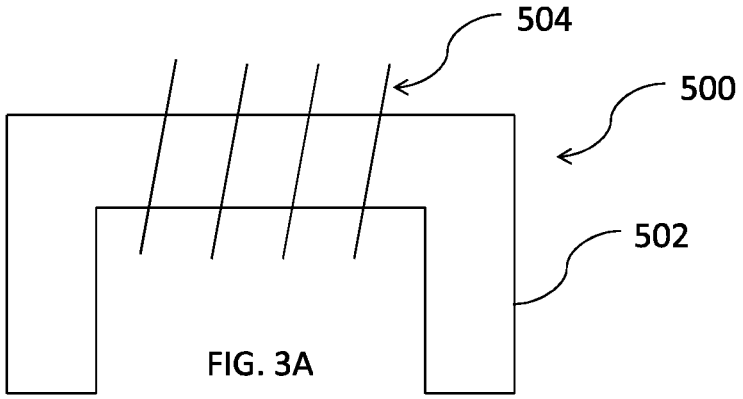
Figure 3B:
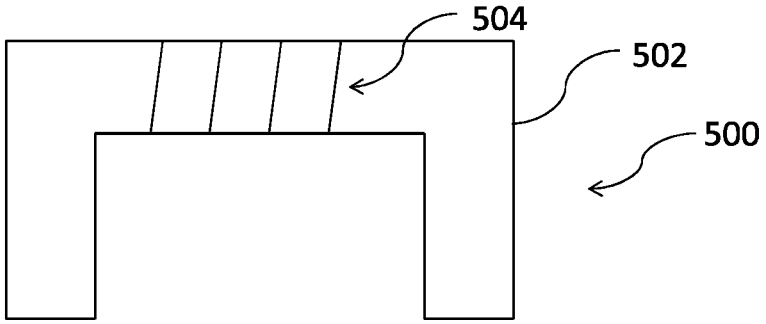
Figure 4:
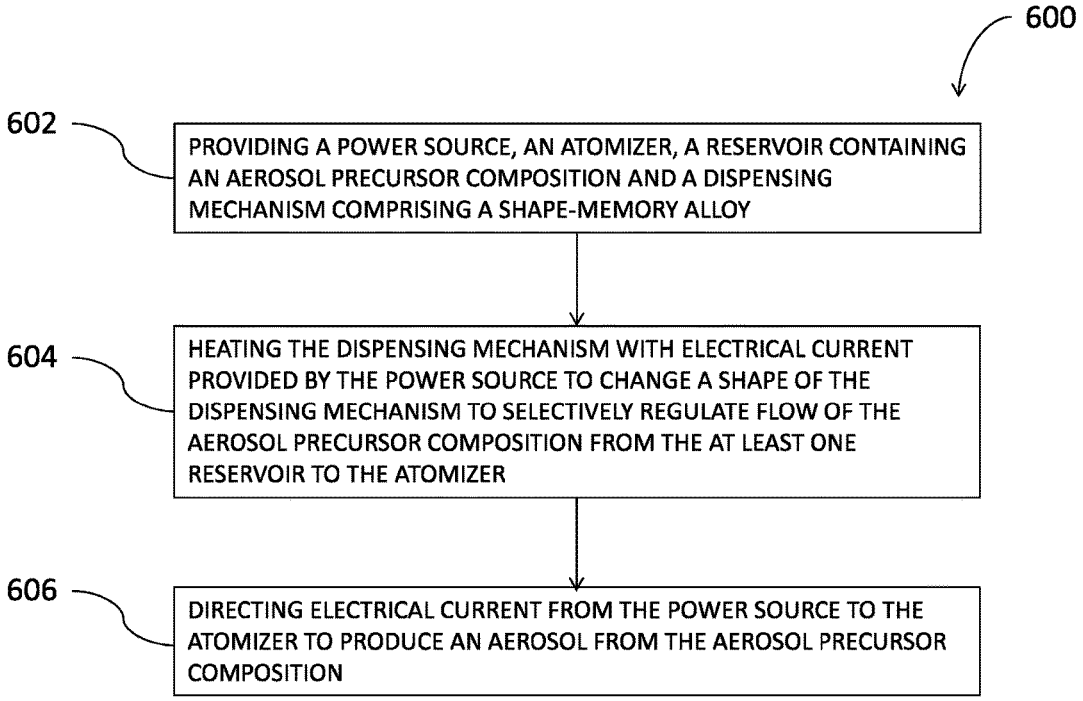

Having thus described the disclosure in the foregoing general terms, reference will now be made to the accompanying drawings, which are not necessarily drawn to scale, and wherein:

FIG. 1A illustrates a cross-sectional side view of an aerosol delivery device having a dispensing mechanism provided as a valve in a closed configuration, the valve comprising a shape-memory alloy, according to an example embodiment of the present disclosure;

FIG. 1B illustrates a cross-sectional side view of the aerosol delivery device of FIG. 1A, the valve being in an open configuration, according to an example embodiment of the present disclosure;

FIG. 2A illustrates a cross-sectional side view of an aerosol delivery device having a dispensing mechanism provided as an actuator in a retracted shape and coupled to a first tooth of a ratchet, the actuator being a shape-memory alloy, according to an example embodiment of the present disclosure;

FIG. 2B illustrates a cross-sectional side view of the aerosol delivery device of FIG. 2A, the actuator being in an extended shape, according to an example embodiment of the present disclosure;

FIG. 2C illustrates a cross-sectional side view of the aerosol delivery device of FIG. 2A, the actuator being in an retracted shape and being coupled to a second tooth of the ratchet, according to an example embodiment of the present disclosure;

FIG. 3A illustrates a side view of a heating element at least partially spaced apart from an outer surface of a liquid transport element, the heating element comprising a shape-memory alloy, according to an example embodiment of the present disclosure;

FIG. 3B illustrates a side view of the heating element of FIG. 3A, the heating element being in contact with the outer surface of the liquid transport element, according to an example embodiment of the present disclosure; and FIG. 4 schematically illustrates a method flow diagram of an aerosol delivery device operation method, according to an example embodiment of the present disclosure.

DETAILED DESCRIPTION OF PREFERRED EMBODIMENTS

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

As described hereinafter, embodiments of the present disclosure relate to aerosol delivery devices and related methods. Aerosol delivery devices according to the present disclosure use electrical energy to heat a material (preferably without combusting the material to any significant degree) to form an inhalable substance; and components of such systems have the form of articles that are most preferably sufficiently compact to be considered hand-held devices. That is, use of components of preferred aerosol delivery devices does not result in the production of smoke in the sense that aerosol results principally from by-products of combustion or pyrolysis of tobacco, but rather, use of those preferred devices results in the production of vapors resulting from volatilization or vaporization of certain components incorporated therein. In preferred embodiments, components of aerosol delivery devices may be characterized as electronic cigarettes, and those electronic cigarettes most preferably incorporate tobacco and/or components derived from tobacco, and hence deliver tobacco derived components in aerosol form.

Aerosol generating components of certain preferred aerosol delivery devices provide many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe that is employed by lighting and burning tobacco (and hence inhaling tobacco smoke), without any substantial degree of combustion of any component thereof. For example, the user of an aerosol generating device of the present disclosure holds and uses that device much like a smoker employs a traditional type of smoking article, draw on one end of that device for inhalation of aerosol produced by that device, take or draw puffs at selected intervals of time, and the like.

Aerosol delivery devices of the present disclosure also are characterized as being suitable vapor-producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas).

Aerosol delivery devices of the present disclosure most preferably comprise some combination of a power source (i.e., an electrical power source), at least one control component (e.g., means for actuating, controlling, regulating and/or ceasing power supplied for heat generation, such as by controlling electrical current flow from an electrical power release unit to other components of the aerosol generating device), an atomizer (e.g., a liquid transport element and an electrical resistance heater or heat generation component), a dispensing mechanism (e.g., a valve or actuator comprising a shape-memory alloy), an aerosol precursor (e.g., a composition that commonly is a liquid capable of yielding an aerosol upon application of sufficient heat, such as ingredients commonly referred to as "smoke juice," "e-liquid" and "e-juice"), and a mouthend region or tip for allowing draw upon the aerosol delivery device for aerosol inhalation (e.g., a defined air flow path through the aerosol delivery device such that aerosol generated is withdrawn therefrom upon draw by a user).

More specific formats, configurations, and arrangements of components within the aerosol delivery devices of the present disclosure will be evident in light of the further disclosure provided hereinafter. Additionally, the selection and arrangement of various aerosol delivery device components can be appreciated upon consideration of the commercially available electronic aerosol delivery devices, such as those representative products referenced in the background art section of the present disclosure.

Alignment of the components within the aerosol delivery device is variable. In specific embodiments, the aerosol precursor composition is located centrally relative to two opposing ends of the device (e.g., within a reservoir of a cartridge, which in certain circumstances is replaceable and disposable or refillable). Other configurations, however, are not excluded. Generally, the components are configured relative to one another so that heat from the heating element volatilizes the aerosol precursor composition (as well as one or more flavorants, medicaments, or the like that may likewise be provided for delivery to a user) and forms an aerosol for delivery to the user. When the heating element heats the aerosol precursor composition, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof.

An aerosol delivery device incorporates a battery or other electrical power source to provide current flow sufficient to provide various functionalities to the device, such as powering of a heater, powering of control systems, powering of indicators, actuating the dispensing mechanism, and the like. The power source can take on various embodiments. Preferably, the power source is able to deliver sufficient power to rapidly heat the heating element and/or the dispensing mechanism to provide for aerosol formation and power the article through use for the desired duration of time. The power source preferably is sized to fit conveniently within the aerosol delivery device so that the aerosol delivery device can be easily handled; and additionally, a preferred power source is of a sufficiently light weight to not detract from a desirable smoking experience. For example, the power source is a battery.

In some embodiments, a cartridge includes a base that comprises anti-rotation features that substantially prevent relative rotation between the cartridge and the control body as disclosed in U.S. Pat. App. Pub. No. 2014/0261495 to Novak et al., which is incorporated herein by reference in its entirety.

The atomizer unit may comprise one or more heater components that are used in the present aerosol delivery device. In various embodiments, one or more microheaters or like solid state heaters are used. Embodiments of microheaters that are utilized are further described herein. Further microheaters and atomizers incorporating microheaters suitable for use in the presently disclosed devices are described in U.S. Pat. No. 8,881,737 to Collett et al., which is incorporated herein by reference in its entirety. In some embodiments, a heating element is formed by winding a coil about a liquid transport element as described in U.S. Pat. No. 9,210,738 to Ward et al., which is incorporated herein by reference in its entirety. Further, in some embodiments the coil comprises a variable coil spacing, as described in U.S. Pat. No. 9,277,770 to DePiano et al., which is incorporated herein by reference in its entirety. Various embodiments of materials configured to produce heat when electrical current is applied therethrough are employed to form a resistive heating element. Example materials from which the wire coil is formed include Kanthal (FeCrAl), Nichrome, nickel titanium (NiTi), Molybdenum disilicide (MoSi2), molybdenum silicide (MoSi), Molybdenum disilicide doped with Aluminum (Mo(Si,Al)2), graphite and graphite-based materials; ceramic (e.g., a positive or negative temperature coefficient ceramic), and copper/aluminum/nickel alloys. In further embodiments, a stamped heating element is employed in the atomizer, as described in U.S. Pat. App. Pub. No. 2014/0270729 to DePiano et al., which is incorporated herein by reference in its entirety. Further to the above, additional representative heating elements and materials for use therein are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties. Further, chemical heating may be employed in other embodiments. Various additional examples of heaters and materials employed to form heaters are described in U.S. Pat. No. 8,881,737 to Collett et al., which is incorporated herein by reference, as noted above.

In some embodiments the aerosol delivery devices of the present disclosure includes a control body, an atomizer unit, and a cartridge. When the control body is coupled to the cartridge and/or the atomizer unit, an electronic component (not shown) in the cartridge forms an electrical connection with the control body. The control body thus employs the electronic component to determine whether the cartridge is genuine and/or perform other functions. Further, various examples of electronic components and functions performed thereby are described in U.S. Pat. App. Pub. No. 2014/0096781 to Sears et al., which is incorporated herein by reference in its entirety.

During use, a user draws on a mouthpiece, which may be provided at the atomizer unit or any other portion of the aerosol delivery device. This may pull air through an opening in the control body, in the atomizer unit, or in the cartridge. For example, in one embodiment an opening is defined between the coupler and the outer body of the control body, as described in U.S. Pat. No. 9,220,302 to DePiano et al., which is incorporated herein by reference in its entirety. However, the flow of air is received through other parts of the aerosol delivery device in other embodiments.

A sensor in the aerosol delivery device (e.g., a puff or flow sensor in the control body) detects the puff. The puff sensor is configured to output a signal corresponding to a draw on the aerosol delivery device. The control body is thereby configured, in response to detection of the puff by the sensor, to output electrical current to heat the aerosol precursor composition dispensed to the atomizer. Accordingly, the heater vaporizes the aerosol precursor composition, and the mouthpiece allows passage of air and entrained vapor (i.e., the components of the aerosol precursor composition in an inhalable form) from the cartridge to a consumer drawing thereon.

Various other details with respect to the components that may be included in the cartridge are provided, for example, in U.S. Pat. App. Pub. No. 2014/0261495 to Novak et al., which is incorporated herein by reference in its entirety. Various components of an aerosol delivery device according to the present disclosure can be chosen from components described in the art and commercially available. Example embodiments of commercially available aerosol delivery devices are described in U.S. patent application Ser. No. 15/222,615, filed Jul. 28, 2016, to Watson et al., which is incorporated herein by reference in its entirety. Reference is also made, for example, to the cartridge and atomizer unit for controllable delivery of multiple aerosolizable materials in an electronic smoking article disclosed in U.S. Pat. Pub. No. 2014/0000638 to Sebastian et al., which is incorporated herein by reference in its entirety.

In the present disclosure, FIGS. 1A-1B illustrate a cross-sectional view of a first embodiment of an aerosol delivery device, generally designated 100A. The aerosol delivery device comprises a control body 200, a cartridge 300, and an atomizer unit 400 each housed in separable housings. The atomizer unit 400 is engaged with the cartridge 300 at a first end of the cartridge 300, and the control body 200 is engaged with the cartridge 300 at an opposing, second end of the cartridge 300. Each of the control body 200, the cartridge 300, and the atomizer unit 400 is either permanently or detachably aligned in a functional relationship with the adjacent component, through a threaded engagement, a press-fit engagement, interference fit, a magnetic engagement, or the like. In some aspects, the aerosol delivery device 100A is substantially rod-like, substantially tubular shaped, or substantially cylindrically shaped when the cartridge 300, the atomizer unit 400, and the control body 200 are in an assembled configuration.

In specific embodiments, one or more of the control body 200, the cartridge 300, and the atomizer unit 400 are referred to as being disposable or as being reusable. For example, the control body has power source 206 (e.g., a replaceable battery or a rechargeable battery and/or a capacitor) that is combined with any type of recharging technology, including connection to a typical alternating current electrical outlet, connection to a car charger (i.e., cigarette lighter receptacle), and connection to a computer, such as through a universal serial bus (USB) cable. Further, in some embodiments the cartridge comprises a single-use cartridge, as disclosed in U.S. Pat. No. 8,910,639 to Chang et al., which is incorporated herein by reference in its entirety. In another example, the cartridge 300 comprises aerosol precursor composition disposed therein and is configured to be removed and replaced upon vaporization of all the aerosol precursor composition.

The control body 200 comprises a control component (e.g., a controller) 202, a flow sensor 204 (e.g., a puff sensor or pressure switch), and the power source 206. In some aspects, the power source 206 comprises a battery or other electrical power source configured to output electrical current sufficient to provide various functionalities to the aerosol delivery device 100A, such as resistive heating, powering of control components (e.g., control component 202), powering of indicators, powering of a dispensing mechanism, and the like. Preferably, the power source 206 is sized to fit conveniently within the aerosol delivery device 100A so that the aerosol delivery device 100A is easily handled. Additional components of the control body 200 include but are not limited to, for example, an air intake 208, indicators (e.g., a light emitting diode (LED)) (not shown) in varying numbers, different shapes, and/or in an opening in the control body 200 (such as for release of sound when such indicators are present), connector circuitry (not shown) enabling electrical connection with a heating element disposed in the atomizer unit 400 and/or an actuator disposed in the cartridge 300, a coupler (not shown), a sealing member (not shown), an adhesive member (e.g., KAPTON® tape) (not shown), a spacer (not shown), and an end cap (not shown). Examples of electrical power sources are described in U.S. Pat. App. Pub. No. 2010/0028766 by Peckerar et al., the disclosure of which is incorporated herein by reference in its entirety. An exemplary mechanism that provides puff-actuation capability includes a Model 163PC01D36 silicon sensor, manufactured by the MICRO SWITCH™ division of Honeywell, Inc., Freeport, Ill. Further examples of demand-operated electrical switches that may be employed in connector circuitry according to the present disclosure are described in U.S. Pat. No. 4,735,217 to Gerth et al., which is incorporated herein by reference in its entirety. Further description of current regulating circuits and other control components, including microcontrollers that are useful in the present aerosol delivery device, are provided in U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., and U.S. Pat. No. 7,040,314 to Nguyen et al., all of which are incorporated herein by reference in their entireties. Reference also is made to the control schemes described in U.S. Pat. No. 9,423,152 to Ampolini et al., which is incorporated herein by reference in its entirety.

Still further components can be utilized in the aerosol delivery devices of the present disclosure. For example, U.S. Pat. No. 5,154,192 to Sprinkel et al. discloses indicators for smoking articles; U.S. Pat. No. 5,261,424 to Sprinkel, Jr. discloses piezoelectric sensors associated with the mouthend of a device to detect user lip activity associated with taking a draw and then trigger heating; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. Pat. No. 8,402,976 to Fernando et al. discloses computer interfacing means for smoking devices to facilitate charging and allow computer control of the device; U.S. Pat. No. 8,689,804 to Fernando et al. discloses identification systems for smoking devices; and WO 2010/003480 by Flick discloses a fluid flow sensing system indicative of a puff in an aerosol generating system; all of the foregoing disclosures being incorporated herein by reference in their entireties. Further examples of components related to aerosol delivery devices and disclosing materials or components that may be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; U.S. Pat. Nos. 8,156,944 and 8,375,957 to Hon; U.S. Pat. No. 8,794,231 to Thorens et al. and U.S. Pat. No. 8,851,083 to Oglesby et al.; U.S. Pat. App. Pub. Nos. 2006/0196518 and 2009/0188490 to Hon; U.S. Pat. Nos. 8,915,254 and 8,925,555 to Monsees et al.; U.S. Pat. App. Pub. No. 2010/0024834 to Oglesby et al.; U.S. Pat. App. Pub. No. 2010/0307518 to Wang; U.S. Pat. No. 9,220,302 to DePiano et al.; WO 2010/091593 to Hon; WO 2013/089551 to Foo, each of which is incorporated herein by reference in its entirety. A variety of the materials disclosed by the foregoing documents may be incorporated into the present devices in various embodiments, and all of the foregoing disclosures are incorporated herein by reference in their entireties.

The cartridge 300 includes a reservoir 302 containing an aerosol precursor composition 304 therein. The aerosol precursor composition 304 comprises one or more different components. For example, the aerosol precursor composition 304 includes a polyhydric alcohol (e.g., glycerin, propylene glycol, or a mixture thereof), water, nicotine, natural and artificial flavors, menthol, or a mixture thereof. Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. Additional description with respect to embodiments of aerosol precursor compositions, including description of tobacco or components derived from tobacco included therein, is provided in U.S. patent application Ser. Nos. 15/216,582 and 15/216,590, each filed Jul. 21, 2016 and each to Davis et al., which are incorporated herein by reference in their entireties.

The cartridge 300 further includes a longitudinally extending air flow channel 318, which extends throughout a longitudinal length of the cartridge 300. The air flow channel 318 defines a port at a first longitudinal end that is in fluid communication with the air intake 208 and defines a port at an opposing, second longitudinal end that is in communication with a flow path 404 (described in more detail below) of atomizer unit. The air flow channel 318 is configured to direct ambient air from the air intake 208 to a location proximate an atomizer 402 (described in more detail below) in order to form an inhalable substance for a consumer user.

The atomizer unit 400 includes the atomizer 402, the flow path 404 defined by an interior structure of the atomizer unit 400, and a mouthend region having a mouthpiece 406. The mouthend region is defined opposite the end of the atomizer unit 400 that is engaged with the cartridge 300. The mouthpiece 406 comprises an opening therethrough to allow passage of air and entrained vapor (i.e., the components of the aerosol precursor composition in an inhalable aerosol form) from the atomizer unit 400 to a consumer during draw on the aerosol delivery device 100A.

The interior of the atomizer unit 400 comprises internal structures that form the flow path 404. For example, and as illustrated in FIGS. 1A-1B, the flow path 404 is configured in multiple portions, a first portion being defined between two internal structures of the housing of the atomizer unit 400 and substantially parallel to the direction of flow through a port 310 defined between the reservoir 302 and the atomizer 402. A second portion of the flow path 404 is defined between the atomizer unit 402 and an internal structure of the housing and substantially perpendicular to the direction of flow through the port 310. Thus, the first and second portions of the flow path 404 are disposed approximately 90 degrees relative to one another. A third portion of the flow path 404 is defined between an internal structure of the housing of the atomizer unit 400 and an interior of the housing of the of the atomizer unit 400 and is also substantially parallel to the port 310. The third portion of the flow path 404 is in fluid communication with the opposing, second end of the air flow channel 318. The mouthpiece 406 is positioned adjacent to and in fluid communication with the third portion of the flow path 404. Accordingly, once the aerosol precursor composition 304 is delivered from the reservoir 302 to the atomizer 402 through the flow path 404, the atomizer 402 is configured to heat the aerosol precursor composition 304 in order to produce an aerosol therefrom. The ambient air directed from the flow intake 208 and through the air flow channel 318 is mixed with the aerosol to form an inhalable substance. The formed inhalable substance is directed from the third portion of the flow path 404 to the mouthpiece 406 for delivery to a consumer.

In some aspects, the atomizer 402 comprises a resistive heating element comprising a wire coil that is in electrical communication with the battery 206 and is configured to generate heat in response to current received therefrom, and a liquid transport element comprising a wick that is configured to direct the aerosol precursor composition(s) into interaction with the heat generated by the heating element in order to produce the aerosol upon interaction with the heat. An exemplary embodiment of the atomizer 402, where the wire coil acts as a dispensing mechanism as well as a resistive heating element, is provided in reference to FIGS. 3A-3B.

Various embodiments of materials configured to produce heat when electrical current is applied therethrough are employed to form the wire coil. Example materials from which the wire coil is formed include Kanthal (FeCrAl), Nichrome, Molybdenum disilicide ($MoSi_2$), molybdenum silicide (MoSi), Molybdenum disilicide doped with Aluminum ($Mo(Si,Al)_2$), and ceramic (e.g., a positive temperature coefficient ceramic). Alternatively, the wire coil is formed of a shape-memory alloy, such as nickel titanium, to be described in more detail with regard to FIGS. 3A-3B. The liquid transport element is also formed from a variety of materials configured to transport a liquid. For example, the liquid transport element comprises cotton and/or fiberglass in some embodiments. Electrically conductive heater terminals (e.g., positive and negative terminals) at the opposing ends of the heating element are configured to direct current flow through the heating element and configured for attachment to the appropriate wiring or connector circuit (not shown) to form an electrical connection of the heating element with the battery 206 when the atomizer unit 400 is engaged with the cartridge 300 and the control body 200. Additional example configurations of the atomizer 402 and components thereof are provided in U.S. Pat. Appl. Publ. Nos. 2015/0117842, 2015/0114409, and 2015/0117841, each to Brammer et al., which are incorporated herein by reference in their entireties.

When the atomizer unit 400 is engaged with the cartridge 300 and the control body 200, the aerosol precursor composition 304 is configured to be selectively dispensed from the reservoir 302 of the cartridge 300 to the atomizer unit 400. In this manner, a dispensing mechanism 306 is disposed in the reservoir 302 and/or in the atomizer unit 400, where the dispensing mechanism 306 comprises a shape-memory alloy that is configured to change shape in response to heat produced from electrical current provided by the power source 206.

Shape-memory alloys generally refer to a group of metallic materials that demonstrate the ability to return to some previously defined shape or size when subjected to an appropriate thermal stimulus. Shape-memory alloys are capable of undergoing phase transitions in which their yield strength, stiffness, dimension and/or shape are altered as a function of temperature. Generally, in the low temperature, or martensite phase, shape memory alloys can be elastically deformed and upon exposure to some higher temperature will transform to an austenite phase, or parent phase, returning to their shape prior to the deformation.

Shape-memory alloys exist in several different temperature-dependent phases. The most commonly utilized of these phases are the so-called martensite and austenite phases. In the following discussion, the martensite phase generally refers to the more deformable, lower temperature phase whereas the austenite phase generally refers to the more rigid, higher temperature phase. When the shape-memory alloy is in the martensite phase and is heated, it begins to change into the austenite phase. The temperature at which this phenomenon starts is often referred to as austenite start temperature ($A_s$). The temperature at which this phenomenon is complete is called the austenite finish temperature ($A_f$).

When the shape-memory alloy is in the austenite phase and is cooled, it begins to change into the martensite phase, and the temperature at which this phenomenon starts is referred to as the martensite start temperature ($M_s$). The temperature at which austenite finishes transforming to martensite is called the martensite finish temperature ($M_f$). Generally, the shape-memory alloys are softer and more easily deformable in their Martensitic phase and are harder, stiffer, and/or more rigid in the austenitic phase.

Shape-memory alloys can exhibit a one-way shape memory effect, an intrinsic two-way effect, or an extrinsic two-way shape memory effect depending on the alloy composition and processing history. Annealed shape memory alloys typically only exhibit the one-way shape memory effect. Sufficient heating subsequent to low-temperature deformation of the shape memory material will induce the martensite to austenite type transition, and the material will recover the original, annealed shape. Hence, one-way shape memory effects are only observed upon heating. Active materials comprising shape memory alloy compositions that exhibit one-way memory effects do not automatically reform, and require an external mechanical force to return the shape to its previous configuration.

Intrinsic and extrinsic two-way shape memory materials are characterized by a shape transition (i.e., from a first shape to a second shape) both upon heating from the martensite phase to the austenite phase, as well as an additional shape transition (i.e., from the second shape to the first shape) upon cooling from the austenite phase back to the martensite phase. With regard to the present disclosure, the shape-memory alloys described herein exhibit a two-way shape memory effect. Active materials that exhibit an intrinsic shape memory effect are fabricated from a shape-memory alloy composition that will cause the active materials to automatically reform themselves as a result of the above noted phase transformations. Intrinsic two-way shape-memory behavior must be induced in the shape memory material through processing. Such procedures include extreme deformation of the material while in the martensite phase, heating-cooling under constraint or load, or surface modification such as laser annealing, polishing, or shot-peening. Once the material has been trained to exhibit the two-way shape-memory effect, the shape change between the low and high temperature states is generally reversible and persists through a high number of thermal cycles. In contrast, active materials that exhibit the extrinsic two-way shape-memory effects are composite or multi-component materials that combine a shape-memory alloy composition that exhibits a one-way effect with another element that provides a restoring force to reform the original shape.

The temperature at which the shape memory alloy remembers its high temperature form when heated is adjustable by slight changes in the composition of the alloy and through heat treatment. In nickel-titanium shape-memory alloys, for instance, it is changeable from above about 100° C. to below about −100° C. The shape recovery process occurs over a range of just a few degrees and the start or finish of the transformation is controllable to within a degree or two depending on the desired application and alloy composition. The mechanical properties of the shape-memory alloy vary greatly over the temperature range spanning their transformation, typically providing the system with shape memory effects, superelastic effects, and high damping capacity.

Suitable shape-memory alloy materials include, without limitation, nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-platinum based alloys, iron-palladium based alloys, and the like. The alloys can be binary, ternary, or any higher order so long as the alloy composition exhibits a shape memory effect, e.g., change in shape orientation, damping capacity, and the like.

Shape-memory alloys exhibit a modulus increase of 2.5 times and a dimensional change of up to 8% (depending on the amount of pre-strain) when heated above their martensite to austenite phase transition temperature. Stress induced phase changes in shape-memory alloys known as superelasticity (or pseudoelasticity) refer to the ability of shape-memory alloys to return to its original shape upon unloading after a substantial deformation in a two-way manner. Application of sufficient stress when shape-memory alloys are in their austenitic phase will cause them to change to their lower modulus Martensitic phase in which they can exhibit up to 8% of superelastic deformation. Removal of the applied stress will cause the shape-memory alloys to switch back to their austenitic phase in so doing recovering their starting shape and higher modulus, and dissipating energy. More particularly, the application of an externally applied stress causes martensite to form at temperatures higher than $M_s$. The macroscopic deformation is accommodated by the formation of martensite. When the stress is released, the martensite phase transforms back into the austenite phase and the shape-memory alloys return back to their original shape. Superelastic shape-memory alloys can be strained several times more than ordinary metal alloys without being permanently plastically deformed, however, this is only observed over a specific temperature range, with the largest ability to recover occurring close to $A_f$. Additional information regarding shape-memory alloys is provided in U.S. Pat. No. 9,316,212 to Browne et al., which is incorporated herein by reference in its entirety. See also Jani et al., *Materials & Design*, (1980-2015), Vol. 56, pages 1078-1113, and Borden, *Mechanical Engineering*, October 1991, pg. 67-72, which are incorporated herein by reference in their entireties. Additionally, exemplary shape-memory alloys are commercially available from DYNALLOY, Inc. of Irvine, Calif.

In this manner, the shape-memory alloy of the dispensing mechanism 306 is configured to be in communication with the power source 206. In some embodiments, the power source 206 is configured to output electrical current from which heat is produced by the passage of the current through connector circuitry (not shown). Accordingly, where a puff is sensed by the flow sensor 204 (e.g., a puff sensor or pressure switch), electrical current is directed from the power source 206 to heat the shape-memory alloy of the dispensing mechanism 306 to cause it to change shape and provide flow of the aerosol precursor composition to atomizer 402. The heat produced by the output of electrical current is directed, by a controller 202, to the dispensing mechanism 306 via the connector circuitry, as well as to the atomizer 402. In this regard, the electrical current may be directed through the dispensing mechanism 306 such that the dispensing mechanism is heated by resistive heating. Alternatively, a separate heating element may heat the dispensing mechanism 306.

Accordingly, in reference to the present disclosure, the shape-memory alloy of the dispensing mechanism 306, in some embodiments, provides a two-way shape-memory effect. Thus, the dispensing mechanism 306 is configured to change shape in response to heat produced from electrical current provided by the power source 206 from a first shape to a second shape (i.e., from the martensite phase to the austenite phase) and return to the first shape from the second shape (from the austenite phase back to the martensite phase) upon cooling. Preferably, in some embodiments, the shape-memory alloy comprises a nickel-titanium alloy having the following properties: an austenite finish temperature $A_f$ of approximately between 390 degrees Celsius and 410 degrees Celsius, an austenite start temperature $A_s$ of approximately between 145 degrees Celsius and 155 degrees Celsius, a martensite start temperature $M_s$ of approximately between 145 degrees Celsius and 155 degrees Celsius, and a martensite finish temperature $M_f$ of approximately between 55 degrees Celsius and 75 degrees Celsius. In some embodiments, the martensite start temperature $M_s$ and the austenite start temperature $A_s$ are substantially the same.

Regardless of the alloy utilized for the shape-memory alloy, in these embodiments, the dispensing mechanism 306 is configured to begin changing from the first shape to the second shape as soon as the austenite start temperature $A_s$ is reached and completes transformation to the second shape as soon as the austenite finish temperature $A_f$ is reached. Likewise, the dispensing mechanism 306 is configured to begin changing from the second shape to the first shape as soon as the martensite start temperature $M_s$ is reached and completes transformation to the first shape as soon as the martensite finish temperature $M_f$ is reached.

As may be understood, the temperatures at which these transformations occur may be configured to be above normal ambient conditions to which the aerosol delivery device 100A is exposed. As such, the transformation from the first shape to the second shape may only occur when the dispensing mechanism 306 is intentionally heated during the use thereof. Similarly, the temperature at which the transformation from the second shape to the first shape occurs may also be above normal ambient conditions to which the aerosol delivery device is exposed such that the dispensing mechanism may transform back to the first shape. Thus, for example, in a preferred embodiment, the austenite start temperature $A_s$ for the transformation from the first shape to the second shape may occur at a temperature of between about 125 and about 175 degrees Celsius, and the martensite start temperature $M_s$ for the transformation from the second shape to the first shape may occur at a temperature of between about 160 and about 100 degrees Celsius.

In some aspects, the dispensing mechanism 306 is configured as a valve 308, such that the valve 308 is configured to change from a first configuration to a second configuration relative to the port 310 defined between the reservoir 302 and the atomizer 402 in response to heat produced from electrical current from the power source 206. The port 310 comprises a passageway defined between the reservoir 302 and the atomizer 402 when the cartridge 300 is engaged or aligned with atomizer unit 400. In this manner, the aerosol precursor composition 304 is allowed to be dispensed to the atomizer 402 through the port 310 from the reservoir 302 when the valve 308 is in an open configuration (i.e., second shape of the valve) and is prevented from being dispensed from the reservoir 302 through the port 310 to the atomizer 402 when the valve 308 is in a closed configuration (i.e., first shape of the valve).

FIG. 1A illustrates the valve 308 in a first shape, where the valve 308 is in a closed configuration such that the valve 308 is disposed substantially perpendicularly to the direction of flow relative to the port 310, such that flow therethrough is blocked. When the valve 308 is in the closed configuration, there is no heat being produced from electrical current supplied by the power source 206 and, therefore, no heat being provided to the valve 308. Otherwise, if heat is being produced from the electrical current from the power source 206, the heat produced has not heated the shape-memory alloy of the valve 308 to the austenite start temperature $A_s$ at which the shape-memory alloy of the valve 308 is configured to transform or change shape. For example, an austenite start temperature $A_s$ of about 150 degrees Celsius results in the shape-memory alloy of the valve 308 changing from the first configuration to the second, preconfigured configuration.

FIG. 1B illustrates the valve 308 in a second, preconfigured shape, where the valve 308 is in an open configuration such that the valve 308 is disposed substantially parallel to the direction of flow relative to the port 310 or otherwise at least partially displaced from the port such that flow of the aerosol precursor composition 304 may occur therethrough. When the valve 308 is in the open configuration, there is heat being provided from the electrical current from the power source 206 to the valve 308 that heats the shape-memory alloy of the valve 308 to at least the austenite start temperature $A_s$. As long as the temperature of the shape-memory alloy of the valve 308 remains above the austenite start temperature $A_s$, the valve 308 will remain in its second, preconfigured shape and the port 310 will remain an open conduit for the aerosol precursor composition 304 to flow through. However, where the power source 206 ceases to provide electrical current for heating of the valve 308, the shape-memory alloy of the valve 308 will begin to cool and will revert back to the first shape (i.e., closed configuration) once the temperature of the shape-memory alloy cools to the martensite start temperature $M_s$.

Notably, in some aspects, a mechanism (not shown) is provided that is in communication with the controller 202. After the valve 308 has reached and/or exceeded the austenite start temperature $A_s$ and after a desired period of time or other measure relating to the puff, the controller 202 will stop directing current to heat the shape-memory alloy such that the shape-memory alloy cools to the martensite start temperature $M_s$ in order to transform the shape-memory alloy back to the first shape (i.e., closed configuration). In this manner, the mechanism is configured to allow flow of a desired quantity of the aerosol precursor composition 304, such that the shape-memory alloy of the valve 308 is cooled back to the closed configuration concurrently with a desired quantity of the aerosol precursor composition 304 being directed to the atomizer 402 for aerosol production.

Advantageously, the aerosol delivery device 100A provides the ability to significantly limit or wholly prevent leakage of the aerosol precursor composition 304 disposed in the reservoir 302. The valve 308 is utilized to cover the port 310 such that only a certain quantity of the aerosol precursor composition 304 is dispensed per puff and acts to prevent leakage by covering the reservoir 302 when not in use.

FIGS. 2A-2C illustrate a cross-sectional view of a second embodiment of an aerosol delivery device, generally designated 100B. The aerosol delivery device 100B is similar in each of its functional and structural components to the aerosol delivery device 100A illustrated in FIGS. 1A-1B in a number of respects. For example, the aerosol delivery device 100B comprises a control body 200, a cartridge 300, and an atomizer unit 400 each housed in separable housings. The control body 200 comprises all the same components as that of the control body 200 in the embodiment illustrated in FIGS. 1A-1B, including a control component (e.g., a controller) 202, a flow sensor 204 (e.g., a puff sensor or pressure switch), and a power source 206. An air intake 208 is also provided in the control body 200.

The cartridge 300 of the device 100B includes a reservoir 302 containing an aerosol precursor composition 304 therein, similar to the device 100A illustrated in FIGS. 1A-1B. As described above, the air flow channel 318 is defined through a longitudinal length of the cartridge 300, as illustrated in FIGS. 1A-1B, and is in fluid communication with the air intake 208 at a first longitudinal end of the air flow channel 318. The atomizer unit 400 includes an atomizer 402, a flow path 404 defined by an interior structure of the atomizer unit 400 and in fluid communication with an opposing, second end of the air flow channel 318, and a mouthend region having a mouthpiece 406, similar to the device 100A illustrated in FIGS. 1A-1B. A port 310 is defined between the reservoir 302 and the atomizer 402 through which the aerosol precursor composition 304 is dispensed. However, the device 100B comprises a dispensing mechanism 306 that differs from the dispensing mechanism 306 illustrated in FIGS. 1A-1B.

In this regard, whereas the dispensing mechanism 306 described above with respect to FIGS. 1A and 1B comprises a valve 308 that controls flow of the precursor composition, the dispensing mechanism of another embodiment comprises an actuator configured to change from a first shape to a second shape to displace the aerosol precursor composition toward the atomizer. In one embodiment, a piston is engaged with an interior of the reservoir, the piston being configured to move along a longitudinal axis centrally defined in the reservoir in response to actuation of the actuator. One such example configuration of a dispensing mechanism configured as an actuator is illustrated in FIGS. 2A-2C.

The dispensing mechanism 306 illustrated in FIGS. 2A-2C is disposed in the cartridge 300, in a region adjacent to the reservoir 302. In some aspects, the dispensing mechanism 306 comprises an actuator 312 engaged with a ratchet 314. The ratchet 314 is engaged with a piston 316 that is configured to move along a longitudinal axis centrally defined in the reservoir 302 in response to actuation of the actuator 312.

The actuator 312 comprises a shape-memory alloy that is configured to change from a first shape to a second shape in response to electrical current or heat being directed thereto to push the aerosol precursor composition 304 within the reservoir 302 toward the atomizer 402. More particularly, and as illustrated in FIGS. 2A-2C, the actuator 312 is in the form of a spring. The spring may be configurable between a retracted configuration, in which the spring defines a relatively shorter length (see, FIGS. 2A, 2C), and an elongated configuration, in which the spring defines a relatively longer length (see, FIG. 2B).

The actuator 312 is configured to be heated with electrical current provided by the power source 206. More particularly, the power source 206 is configured to output electrical current from which heat is produced by the passage of the current through connector circuitry (not shown). The actuator 312 may itself receive the electrical current and produce heat in response thereto (e.g., through resistive heating), or a separate element may receive the electrical current and heat the actuator. Accordingly, the actuator 312 is configured to be actuated or change from a first shape to a second, preconfigured shape relative to the ratchet 314 in response to heat produced from electrical current from the power source 206.

The ratchet 314 is engaged with both the piston 316 and the actuator 312 such that the actuation (e.g., change in shape or transformation) of the actuator 312 from a first shape to a second shape results in movement of the ratchet 314, and the piston 316 engaged therewith, along the longitudinal axis centrally defined in the reservoir 302. In some exemplary embodiments such as that illustrated in FIGS. 2A-2C, the ratchet 314 comprises a bar or rod having a plurality of angled teeth that allow motion unidirectionally. For example, the plurality of angled teeth of the ratchet 314 allow movement only along the flow direction of the aerosol precursor composition 304. A tooth or pawl (not shown) is engageable with the set of angled teeth of the ratchet 314, so that engagement of each successive tooth of the plurality of teeth with the tooth of the ratchet 314 incrementally moves the piston 316 within the interior of the reservoir 302 along the longitudinal axis in response to change of the actuator 312 from the first shape to the second shape.

As the piston 316 is incrementally moved along the longitudinal axis, a volume of the reservoir 302 is decreased such that the aerosol precursor composition 304 contained therein is forced through the port 310 and into the flow passage 404 towards the atomizer 402. In this regard, the port 310 and/or the flow passage may be relatively small so as to resist flow therethrough except when the piston 316 is displaced. In this manner, the aerosol precursor composition 304 is allowed to be dispensed to the atomizer 402 through the port 310 from the reservoir 302 when the actuator 312 is in a second configuration (i.e., a second, preconfigured extended shape) and is prevented from being dispensed from the reservoir 302 through the port 310 to the atomizer 402 when the actuator 312 is in a first configuration (i.e., first, retracted shape).

FIG. 2A illustrates the actuator 312 in the first configuration, where the actuator 312 is in the first, retracted shape having the outer, free end engaged with the ratchet 314 and a second, opposing end engaged with an interior region of the cartridge 300. When the actuator 312 is in the first configuration, there is no heat being produced from current provided by the power source 206 and, therefore, no heat being provided to the actuator 312. Otherwise, if heat is being produced from the electrical current from the power source 206, the heat produced does not heat the actuator 312 to the austenite start temperature $A_s$ at which the shape-memory alloy of the actuator 312 is configured to change transform or change shape. For example, the austenite start temperature $A_s$ of approximately about 150 degrees Celsius results in the shape-memory alloy of the actuator 312 changing from the first shape to the second, preconfigured shape. Regardless, the piston 316 will not move along the longitudinal axis until a temperature of the shape-memory alloy of the actuator 312 reaches the austenite start temperature $A_s$.

FIG. 2B illustrates the actuator 312 in a second configuration, where the actuator 312 is in a second, extended shape having the outer, free end engaged with the ratchet 314 and a second, opposing end engaged with an interior region of the cartridge 300. When the actuator 312 is in the second configuration, there is heat being produced, or heat has been produced, from electrical current provided by the power source 206 such that the temperature of the shape-memory alloy of the actuator 312 reaches or exceeds the austenite start temperature $A_s$. Once the temperature of the shape-memory alloy of the actuator 312 reaches or exceeds the austenite start temperature $A_s$, the actuator begins to transform from the first retracted shape to the second extended shape. This results in the ratchet 314 being forcibly moved along the longitudinal axis as the actuator 312 extends. As the actuator 312 is heated to or past the austenite start temperature $A_s$, the actuator 312 is configured to extend to its maximum extended length, which corresponds to one or more increments that the ratchet 314 moves along the longitudinal axis. Each increment is determined by a length of each tooth on the ratchet. Therefore, a maximum length that the actuator 312 is capable of extending is configurable relative a length of each tooth of the ratchet 314. For example, in one embodiment, at the maximum extended length of the actuator 312, the ratchet 314 moves a distance equivalent to one ratchet length and pushes an equivalent quantity of the aerosol precursor composition 304 to the atomizer 402. Once the maximum extended length of the actuator 312 is achieved, the piston 316 will then remain at its current position relative to the cartridge 300, as the tooth or pawl of the piston 316 engaged with the ratchet 314 prevents movement of the ratchet in the opposite direction, or the actuator 312 itself prevents such motion.

However, where the power source 206 ceases to provide electrical current, such that heat is no longer produced therefrom, the shape-memory alloy of the actuator 312 will begin to cool and will revert back to the first retracted configuration (i.e., first shape) once the temperature of the shape-memory alloy cools to the martensite start temperature $M_s$. In the first shape, the ratchet 314 and the piston 316 will be maintained at the same position relative to the cartridge 300, as the pawl or tooth of the piston 316 or the actuator 312 itself prevents movement of the ratchet 314 in the opposite direction.

FIG. 2C illustrates the actuator 312 returned to the first configuration, where the actuator 312 is in the first retracted shape after cooling to the martensite start temperature $M_s$. Notably, upon return transformation from the second, elongated shape to the first, retracted shape, the outer, free end of the actuator 312 engages a new tooth further from the piston 316 so as to substantially retain the piston 316 in the position corresponding to the previous elongated configuration of the actuator. In this manner, the actuator 312 substantially provides unidirectional movement of the piston 316 towards the atomizer unit 400 and substantially prevents movement of the piston in the opposing direction towards the control body 200.

FIGS. 3A-3B illustrate a side view of an exemplary embodiment of an atomizer, generally designated 500. The atomizer 500 is configured to be implemented as an atomizer similar to the atomizer 402 included in the aerosol delivery devices 100A, 100B in FIGS. 1A-1B and FIGS. 2A-2C, in some embodiments, whereas in other embodiments the atomizer 500 is configured to be implemented in a conventional aerosol delivery device. The atomizer 500 comprises a liquid transport element 502 and a heating element 504. The heating element 504, in some regards, is configured as a resistive heating element as well as a dispensing mechanism within the meaning of this disclosure. More particularly, the heating element 504 is configured to selectively regulate flow of the aerosol precursor composition from the reservoir to the atomizer, the atomizer being configured to produce an aerosol therefrom, as does the dispensing mechanism 306 provided in each of FIGS. 1A-1B and 2A-2C.

In some embodiments, the heating element 504 includes one or more coils comprising a shape-memory alloy wrapped about the liquid transport element 502. The shape-memory alloy of the heating element 504 comprises all of the same characteristics described above. Thus, when the heating element 504 receives electrical current from a power source (e.g., power source 206, FIGS. 1A-2C), the heating element 504 is configured to not only heat the aerosol precursor composition provided thereto by the liquid transport element 502, but also to change from a first shape to a second shape about the liquid transport element 502 in order to selectively regulate flow of the aerosol precursor composition from the reservoir to the atomizer.

Advantageously, the aerosol delivery device 100B, as well as the aerosol delivery device 100A, separably houses the cartridge 300 and the atomizer unit 400 so that aerosol precursor composition cartridges are replaceable without necessarily replacing the atomizer unit 400 or the control body 200. Therefore, this is a cost-effective approach to a reusable aerosol delivery device as varying flavors, types, nicotine-strengths, etc., of aerosol precursor composition are able to be switched out while retaining the same control body and atomizer unit.

More specifically, and as illustrated in FIG. 3A, the heating element 504 is in a first shape, where the one or more coils of the heating element 504 are at least partially spaced apart from an outer surface of the liquid transport element 502. In this manner, the outer surface of the liquid transport element 502 is exposed to allow flow of the aerosol precursor composition (e.g., 304, FIGS. 1A-2C) into the liquid transport element 502 substantially without providing a constriction. When the heating element 504 is in the first shape, there is no heat being produced from current provided by the power source and, therefore, no heat being produced by the heating element 504. Otherwise, if heat is being produced from the electrical current from the power source, the heat produced does not heat the shape-memory alloy of the heating element 504 to an austenite start temperature $A_s$ at which the shape-memory alloy of the heating element 504 is configured to transform or change shape. For example, an austenite start temperature $A_s$ of about 150 degrees Celsius results in the shape-memory alloy of the heating element 504 changing from the first shape to the second, preconfigured shape.

Conversely, and as illustrated in FIG. 3B, the heating element 504 is in a second, preconfigured shape, where the one or more coils of the heating element 504 are in contact with the outer surface of the liquid transport element 502 to heat the aerosol precursor composition at the liquid transport element 502 and thereby produce the aerosol, in response to heat produced from electrical current from the power source. When the heating element 504 is in the second, preconfigured shape, the temperature of the shape-memory alloy of the heating element 504 has exceeded the austenite start temperature $A_s$. As long as the temperature of the heating element 504 remains above austenite start temperature $A_s$, the heating element 504 will remain in its second, preconfigured shape and will heat the aerosol precursor composition absorbed by the liquid transport element 502. However, upon cessation of receipt of electrical current, such that heat is no longer produced thereby, the shape-memory alloy of the heating element 504 will begin to cool and will return from the second shape to the first shape once the temperature of the shape-memory alloy reaches the martensite start temperature $M_s$.

Advantages of an atomizer configured with a shape-memory alloy in this manner include better wicking replenishment, as the heating element 504 is not always disposed in direct contact with the outer surface of the liquid transport element 502 and more surface area of the liquid transport element 502 is exposed without a constriction. Additionally, by disposing the atomizer 500 in an atomizer unit (e.g., atomizer unit 400, FIGS. 1A-2B) separately from the cartridge where the reservoir is provided, there is increased customization and flexibility that is achieved as a single atomizer is interchangeable with cartridges comprising a variety of different aerosol precursor compositions. Further, this configuration allows replacement of the cartridge without requiring replacement of the atomizer, as is commonly the case in existing embodiments of aerosol delivery devices.

Referring now to FIG. 4, an aerosol delivery device operation method, generally designated 600, is provided. The aerosol delivery device operation is configured to utilize an aerosol delivery device, such as, for example, the aerosol delivery device 100A or the aerosol delivery device 100B described hereinabove. In a first step, 602, a power source, an atomizer, a reservoir containing an aerosol precursor composition and a dispensing mechanism comprising a shape-memory alloy are provided or are otherwise made available. In some exemplary embodiments, each of the power source, the atomizer, the reservoir, and the dispensing mechanism are those described herein in reference to FIGS. 1A-1B, FIGS. 2A-2B, and/or FIGS. 3A-3B.

In a second step, 604, the dispensing mechanism is heated with electrical current output by the power source to change a shape of the dispensing mechanism in order to selectively regulate flow of the aerosol precursor composition from the reservoir to the atomizer.

In a third step, 606, electrical current is directed from the power source to the atomizer to produce an aerosol from the aerosol precursor composition.

In some embodiments, providing the atomizer in step 602 may comprise providing a heating element that is the dispensing mechanism and which includes one or more coils comprising the shape-memory alloy and a liquid transport element, the one or more coils being wrapped about the liquid transport element. In step 604, changing the shape of the dispensing mechanism may comprise changing, of the one or more coils, from a first shape, where the one or more coils are at least partially spaced apart from an outer surface of the liquid transport element to allow flow of the aerosol precursor composition into the liquid transport element, to a second shape, wherein the one or more coils are in contact with the outer surface of the liquid transport element to heat the aerosol precursor composition at the liquid transport element and thereby produce the aerosol, in response to heat produced from electrical current from the power source. The method may further comprise returning the coils from the second shape to the first shape by ceasing the flow of electrical current thereto.

In some embodiments, changing the shape of the dispensing mechanism in step 604, which comprises a valve, may comprise changing from a first shape, where the valve is in a closed configuration to prevent the aerosol precursor composition from being dispensed from the reservoir to the atomizer, to a second shape, where the valve is in an open configuration to allow the aerosol precursor composition to be dispensed to the atomizer from the reservoir, relative to a port defined between the reservoir and the atomizer in response to heat produced from electrical current from the power source. The method may further comprise ceasing receipt of electrical current at the valve. The method may comprise returning, of the valve, from the second shape to the first shape in response thereto.

In some embodiments, the method may further comprise detecting, by a sensor, a draw. Heating the dispensing mechanism in step 604 with electrical current provided by the power source may be controlled in response to detection of the draw.

In some embodiments, changing the shape of the dispensing mechanism in step 604 may comprise changing the shape of an actuator from a first shape to a second shape to displace the aerosol precursor composition toward the atomizer. Changing the shape of the actuator from the first shape to the second shape may comprise moving a piston engaged with an interior of the reservoir along a longitudinal axis centrally defined in the reservoir in response to actuation of the actuator.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An aerosol delivery device comprising:

a power source configured to output electrical current;

an atomizer in fluid communication with a reservoir containing an aerosol precursor composition, the atomizer being configured to receive electrical current from the power source;

a dispensing mechanism comprising a shape-memory alloy configured to change shape in response to heat produced from electrical current provided by the power source and to selectively regulate flow of the aerosol precursor composition from the reservoir to the atomizer, the atomizer being configured to produce an aerosol therefrom; and a flow sensor configured to output a signal corresponding to a draw on the aerosol delivery device and a controller configured to output electrical current to produce heat to change the shape of the dispensing mechanism in response to detection of the draw.

2. The aerosol delivery device of claim 1, wherein the atomizer comprises a liquid transport element and a heating element.

3. The aerosol delivery device of claim 2, wherein the heating element is the dispensing mechanism and includes one or more coils comprising the shape-memory alloy wrapped about the liquid transport element and configured to change from a first shape, where the one or more coils are at least partially spaced apart from an outer surface of the liquid transport element to allow flow of the aerosol precursor composition into the liquid transport element, to a second shape, wherein the one or more coils are in contact with the outer surface of the liquid transport element to heat the aerosol precursor composition at the liquid transport element and thereby produce the aerosol, in response to heat produced from electrical current from the power source.

4. The aerosol delivery device of claim 3, wherein upon cessation of receipt of electrical current at the one or more coils, the one or more coils are configured to return from the second shape to the first shape.

5. The aerosol delivery device of claim 1, wherein the dispensing mechanism comprises a valve.

6. The aerosol delivery device of claim 5, wherein the valve is configured to change from a first shape, where the valve is in a closed configuration to prevent the aerosol precursor composition from being dispensed from the reservoir to the atomizer, to a second shape, where the valve is in an open configuration to allow the aerosol precursor composition to be dispensed to the atomizer from the reservoir, relative to a port defined between the reservoir and the atomizer in response to heat produced from electrical current from the power source.

7. The aerosol delivery device of claim 6, wherein upon cessation of receipt of electrical current at the valve, the valve is configured to return from the second shape to the first shape.

8. The aerosol delivery device of claim 1, wherein the power source, the reservoir, and the atomizer are each housed in separable housings.

9. The aerosol delivery device of claim 1, wherein the shape-memory alloy comprises a nickel titanium (NiTi) alloy.

10. The aerosol delivery device of claim 1, wherein the dispensing mechanism comprises an actuator configured to change from a first shape to a second shape to displace the aerosol precursor composition toward the atomizer.

11. The aerosol delivery device of claim 10, wherein the dispensing mechanism further comprises a piston engaged with an interior of the reservoir, the piston being configured to move along a longitudinal axis centrally defined in the reservoir in response to actuation of the actuator.

12. An aerosol delivery device operation method, comprising:

providing a power source, an atomizer, a reservoir containing an aerosol precursor composition, and a dispensing mechanism comprising a shape-memory alloy;

heating the dispensing mechanism with electrical current output by the power source to change a shape of the dispensing mechanism in order to selectively regulate flow of the aerosol precursor composition from the reservoir to the atomizer;

directing electrical current from the power source to the atomizer to produce an aerosol from the aerosol precursor composition; and detecting, by a flow sensor, a draw on the aerosol delivery device, wherein heating the dispensing mechanism with electrical current provided by the power source is controlled in response to detection of the draw.

13. The aerosol delivery device operation method of claim 12, wherein providing the atomizer comprises providing a heating element that is the dispensing mechanism and which includes one or more coils comprising the shape-memory alloy and a liquid transport element, the one or more coils being wrapped about the liquid transport element; and wherein changing the shape of the dispensing mechanism comprises changing, of the one or more coils, from a first shape, where the one or more coils are at least partially spaced apart from an outer surface of the liquid transport element to allow flow of the aerosol precursor composition into the liquid transport element, to a second shape, wherein the one or more coils are in contact with the outer surface of the liquid transport element to heat the aerosol precursor composition at the liquid transport element and thereby produce the aerosol, in response to heat produced from electrical current from the power source.

14. The aerosol delivery device operation method of claim 13, further comprising returning the coils from the second shape to the first shape by ceasing the flow of electrical current thereto.

15. The aerosol delivery device operation method of claim 12, wherein changing the shape of the dispensing mechanism, which comprises a valve, comprises changing from a first shape, where the valve is in a closed configuration to prevent the aerosol precursor composition from being dispensed from the reservoir to the atomizer, to a second shape, where the valve is in an open configuration to allow the aerosol precursor composition to be dispensed to the atomizer from the reservoir, relative to a port defined between the reservoir and the atomizer in response to heat produced from electrical current from the power source.

16. The aerosol delivery device operation method of claim 15, further comprising: ceasing receipt of electrical current at the valve; and returning, of the valve, from the second shape to the first shape in response thereto.

17. The aerosol delivery device operation method of claim 12, wherein changing the shape of the dispensing mechanism comprises changing the shape of an actuator from a first shape to a second shape to displace the aerosol precursor composition toward the atomizer.

18. The aerosol delivery device operation method of claim 17, wherein changing the shape of the actuator from the first shape to the second shape comprises moving a piston engaged with an interior of the reservoir along a longitudinal axis centrally defined in the reservoir in response to actuation of the actuator.

* * * * *